US008556260B2

(12) United States Patent
Stemmle

(10) Patent No.: US 8,556,260 B2
(45) Date of Patent: Oct. 15, 2013

(54) METHOD FOR OPTIMALLY LOADING OBJECTS INTO STORAGE/TRANSPORT CONTAINERS

(75) Inventor: Denis J. Stemmle, Stratford, CT (US)

(73) Assignee: Lockheed Martin Corporation, Bethesda, MD (US)

( * ) Notice: Subject to any disclaimer, the term of this patent is extended or adjusted under 35 U.S.C. 154(b) by 1873 days.

(21) Appl. No.: 11/441,988

(22) Filed: May 26, 2006

(65) Prior Publication Data

US 2007/0273086 A1 Nov. 29, 2007

(51) Int. Cl.
*B65H 7/02* (2006.01)
*B65H 5/00* (2006.01)

(52) U.S. Cl.
USPC ..... 271/265.04; 271/3.15

(58) Field of Classification Search
USPC ..... 271/3.15, 265.04, 176, 262, 263
See application file for complete search history.

(56) References Cited

U.S. PATENT DOCUMENTS

| | | | | |
|---|---|---|---|---|
| 3,420,368 | A | 1/1969 | Sorrells | |
| 3,452,509 | A | 7/1969 | Hauer | |
| 3,587,856 | A | 6/1971 | Lemelson | |
| 3,757,939 | A | 9/1973 | Henig | |
| 3,889,811 | A | 6/1975 | Yoshimura | |
| 3,901,797 | A | 8/1975 | Storace | |
| 3,904,516 | A | 9/1975 | Chiba | |
| 3,933,094 | A | 1/1976 | Murphy | |
| 4,008,813 | A | 2/1977 | Leersnijder | |
| 4,058,217 | A | 11/1977 | Vaughan | |
| 4,068,385 | A | 1/1978 | Mitzel | 33/143 L |
| 4,077,620 | A | 3/1978 | Frank | |
| 4,106,636 | A | 8/1978 | Ouimet | |

(Continued)

FOREIGN PATENT DOCUMENTS

| | | | |
|---|---|---|---|
| EP | 0661106 | A2 | 7/1995 |
| EP | 1649940 | A2 | 4/2006 |

(Continued)

OTHER PUBLICATIONS

"Development of in-process skew and shift adjusting mechanism for paper handling," American Society of Mechanical Engineers http://www.directtextbook.com, 1998.

(Continued)

*Primary Examiner* — Patrick Cicchino
(74) *Attorney, Agent, or Firm* — Marcus P. Efthimiou; Andrew M. Calderon; Roberts Mlotkowski Safran & Cole, P.C.

(57) ABSTRACT

A method for stacking objects in a container including the step of measuring a thickness value of each object at a plurality of predetermined locations along a face surface of the respective object. A cumulative thickness profile is developed indicative of a plurality of stacked objects, i.e., juxtaposed along each face surface. The cumulative thickness profile is, furthermore, calculated by summing each of the measured thickness dimensions at each of the predetermined locations. Next, a maximum thickness value is determined as each of the objects is measured and compared to a maximum fill value for each container to determine an overfill condition/number. The overfill condition corresponds to the number of objects which additively cause the maximum thickness value to exceed the maximum fill value. The objects may then be stacked based upon the overfill condition such that the total number of objects is less than the number corresponding to the overfill condition. The method facilitates optimum stacking of objects wherein at least one object has an irregular shape or non-uniform thickness profile.

11 Claims, 6 Drawing Sheets

(56) References Cited

U.S. PATENT DOCUMENTS

| | | | | |
|---|---|---|---|---|
| 4,169,529 | A | 10/1979 | Hunter | |
| 4,244,672 | A | 1/1981 | Lund | |
| 4,507,739 | A | 3/1985 | Haruki | |
| 4,627,540 | A | 12/1986 | Takeda | |
| 4,688,678 | A | 8/1987 | Zue | |
| 4,738,368 | A | 4/1988 | Shaw | |
| 4,868,570 | A | 9/1989 | Davis | |
| 4,874,281 | A | 10/1989 | Bergerioux | |
| 4,891,088 | A | 1/1990 | Svyatsky | |
| 4,895,242 | A | 1/1990 | Michel | |
| 4,921,107 | A | 5/1990 | Hofer | |
| 4,923,022 | A | 5/1990 | Hsieh | |
| 4,953,842 | A | 9/1990 | Tolmie et al. | 271/2 |
| 4,965,829 | A | 10/1990 | Lemelson | |
| 5,029,832 | A | 7/1991 | Orsinger | |
| 5,031,223 | A | 7/1991 | Rosenbaum | |
| 5,042,667 | A | 8/1991 | Keough | |
| 5,119,954 | A | 6/1992 | Svyatsky | |
| 5,186,336 | A | 2/1993 | Pippin | |
| 5,238,123 | A | 8/1993 | Tovini et al. | 209/556 |
| 5,291,002 | A | 3/1994 | Agnew | |
| 5,338,149 | A | 8/1994 | Wiseman | |
| 5,470,427 | A | 11/1995 | Mikel | |
| 5,480,032 | A | 1/1996 | Pippin | |
| 5,593,044 | A * | 1/1997 | Yamashita et al. | 209/584 |
| 5,655,668 | A * | 8/1997 | Drenth | 209/603 |
| 5,718,321 | A | 2/1998 | Brugger | |
| 5,908,116 | A * | 6/1999 | Levaro et al. | 209/584 |
| 5,981,891 | A | 11/1999 | Yamashita | |
| 6,126,017 | A | 10/2000 | Hours | |
| 6,135,292 | A * | 10/2000 | Pettner | 209/603 |
| 6,227,378 | B1 | 5/2001 | Jones | |
| 6,276,509 | B1 | 8/2001 | Schuster | |
| 6,347,710 | B1 | 2/2002 | Ryan | |
| 6,365,862 | B1 | 4/2002 | Miller | |
| 6,373,013 | B1 * | 4/2002 | Yamashita et al. | 209/584 |
| 6,403,906 | B1 | 6/2002 | De Leo | |
| 6,435,353 | B2 | 8/2002 | Ryan | |
| 6,443,311 | B2 | 9/2002 | Hendrickson | |
| 6,561,339 | B1 | 5/2003 | Olson | |
| 6,561,360 | B1 | 5/2003 | Kalm | |
| 6,655,683 | B2 | 12/2003 | Engarto | |
| 6,677,548 | B2 | 1/2004 | Robu | |
| 6,734,417 | B2 * | 5/2004 | Vejtasa | 250/231.13 |
| 6,749,194 | B2 * | 6/2004 | Hanson et al. | 271/176 |
| 6,814,210 | B1 | 11/2004 | Hendzel | |
| 6,897,395 | B2 | 5/2005 | Shiibashi | |
| 6,946,612 | B2 | 9/2005 | Morikawa | |
| 6,953,906 | B2 | 10/2005 | Burns | |
| 6,959,923 | B2 | 11/2005 | Leitz | |
| 6,994,220 | B2 | 2/2006 | Schererz | |
| 7,004,396 | B1 | 2/2006 | Quine | |
| 7,029,225 | B2 | 4/2006 | Zimmermann | |
| 7,111,742 | B1 | 9/2006 | Zimmermann | |
| 7,112,031 | B2 | 9/2006 | Harres | |
| 7,138,596 | B2 | 11/2006 | Pippin | |
| 7,170,024 | B2 | 1/2007 | Burns | |
| 7,210,893 | B1 | 5/2007 | Overman | |
| 7,227,094 | B2 | 6/2007 | Oexle | |
| 7,235,756 | B2 | 6/2007 | De Leo | |
| 7,259,346 | B2 | 8/2007 | Svyatsky | |
| 7,304,260 | B2 | 12/2007 | Boller | |
| 7,378,610 | B2 | 5/2008 | Umezawa | |
| 7,396,011 | B2 | 7/2008 | Svyatsky et al. | |
| 7,397,010 | B2 | 7/2008 | Wilke | |
| 7,397,011 | B2 | 7/2008 | Berdelle-Hilge | |
| 2002/0053533 | A1 | 5/2002 | Brehm | |
| 2003/0006174 | A1 | 1/2003 | Harres | |
| 2004/0065996 | A1 * | 4/2004 | Ko et al. | 271/262 |
| 2004/0113358 | A1 * | 6/2004 | Engarto et al. | 271/262 |
| 2005/0280833 | A1 | 12/2005 | Dian et al. | 356/630 |
| 2006/0070929 | A1 | 4/2006 | Fry | |
| 2006/0124512 | A1 * | 6/2006 | Quine et al. | 209/584 |
| 2006/0157921 | A1 * | 7/2006 | Ahn et al. | 271/258.01 |
| 2006/0180520 | A1 | 8/2006 | Ehrat | |
| 2006/0186594 | A1 * | 8/2006 | Mitsuya et al. | 271/262 |
| 2006/0191822 | A1 | 8/2006 | Avant | |
| 2007/0090029 | A1 | 4/2007 | Avant | |
| 2007/0131593 | A1 | 6/2007 | Burns | |
| 2007/0272601 | A1 | 11/2007 | Cormack | |
| 2008/0011653 | A1 | 1/2008 | Stemmle | |
| 2008/0012211 | A1 | 1/2008 | Stemmle | |
| 2008/0027986 | A1 | 1/2008 | Stemmle | |
| 2008/0093273 | A1 | 4/2008 | Stemmle | |
| 2008/0093274 | A1 | 4/2008 | Stemmle | |
| 2008/0164185 | A1 | 7/2008 | Stemmle | |

FOREIGN PATENT DOCUMENTS

| | | |
|---|---|---|
| EP | 1860049 A1 * | 11/2007 |
| JP | 1159088 | 6/1989 |
| JP | 1271789 | 10/1989 |
| JP | 10309535 | 11/1998 |
| WO | 88/01543 | 3/1988 |
| WO | 99/47444 | 9/1999 |
| WO | 03/099692 | 12/2003 |

OTHER PUBLICATIONS

European Search Report issued in European counterpart application No. EP 07 00 8672, also published as EP1860049 on Nov. 28, 2007.

* cited by examiner

METHOD FOR OPTIMALLY LOADING OBJECTS INTO STORAGE/TRANSPORT CONTAINERS

TECHNICAL FIELD

The invention disclosed herein relates to stacking objects, and more particularly to a method for optimally stacking objects, such as products or mailpieces, into a storage/transport container.

BACKGROUND ART

The 2003 Presidential Commission Report on the Future of the USPS concluded that the Postal Service should continue to develop effective merging systems that optimize efficiency, e.g., maximize the number of mailpieces shipped with each mile traveled, while minimizing the labor content associated with mailpiece handling. With respect to the latter, all elements of the mail stream (letters, flats, periodicals, post cards, etc) should be sorted, merged, and/or sequenced at a centralized location with the expectation that no subsequent handling would be required at each of the local postal branch offices, i.e., other than the physical delivery to the recipient address.

Most postal services are actively exploring opportunities to reduce the overall cost of processing mail by investing in postal automation equipment and employing state-of-the-art materials management techniques to improve efficiencies in various process steps. In some instances, the savings from automation equipment is, unfortunately, offset by increases in transportation costs. As will be explained in subsequent paragraphs, the costs/inefficiencies in connection with transportation are most clearly evident when investments are considered/made in automated sorting equipment associated with "flats" type mailpieces.

Sorting equipment adapted to handle flats type mailpieces typically employ a gravity feed chute for dropping mailpieces vertically into mail trays arranged below the chute. Occasionally, portions of the mailpieces do not settle properly and partially protrude/extend above the top of the tray. When the filled tray is transported using automated processing equipment, the potential exists for a protruding mailpiece to catch on various mechanisms/components of the automated equipment, e.g., one of the tray transporting, storing, and/or retrieving systems. It will, therefore, be appreciated that such interference can damage the mailpiece or, alternatively, require the system to shut-down to rectify the problem/obstruction. Further, the overall efficiency of the mail sortation system is adversely affected by such stacking errors.

Stacking errors can occur as a result of a variety of non-optimum conditions and/or under a variety of other circumstances. A principle cause, however, may be attributable to a non-uniform thickness profile of at least one of the flats envelopes in the mailpiece container. That is, flats-type envelopes are, due to their relatively large containment pocket, well-suited to mail/deliver irregular-shape objects such as medication/pill containers, record/music discs, articles of clothing, and other lightweight consumer products. As such, these flats mailpieces often exhibit an irregular thickness profile which can disrupt the ability of the mailpiece container to effect an orderly and/or level stacking of mailpiece items therein. For example, when mailpieces having inconsistent thickness are stacked using the drop-chute configuration described above, the stack in the mailpiece container/tray can become thicker on one side of the tray than the other. As such, this can lead to a greater frequency of mailpieces protruding beyond or above the top rim of the tray.

To address the difficulties associated with stacking errors, mailpiece sorting equipment manufacturers have typically employed one of two known methods/solutions. Firstly, the tray capacity may be limited to about 70% of the total capacity. As such, the probability that a mailpiece will protrude beyond the limits/bounds of the container is significantly diminished. Many of the current sorters are equipped with sensors to determine when the height of the mailpiece stack reaches seventy percent (70%) full level. Secondly, sensors may be deployed throughout the tray transport system to detect when or if mailpieces protrude beyond the top of the container/tray. Trays which have been over-filled are typically diverted to a secondary track for an operator to manually adjust the stacking error and return the tray to the primary or principle track.

While these solutions eliminate difficulties associated with equipment jamming or malfunction, the mailpiece container trays are not filled to their full capacity. As a result, the containers are shipped with thirty percent (30%) of its volume as air rather than in mailpiece content. Additionally, the labor cost in operating multi-million dollar sorting equipment remains high due to the human intervention required to correct for stacking errors.

A need therefore exists for a method and system to accommodate mail of inconsistent thickness, reduce stacking errors, and optimally fill the mail containers/trays.

BRIEF DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

Figure 1:
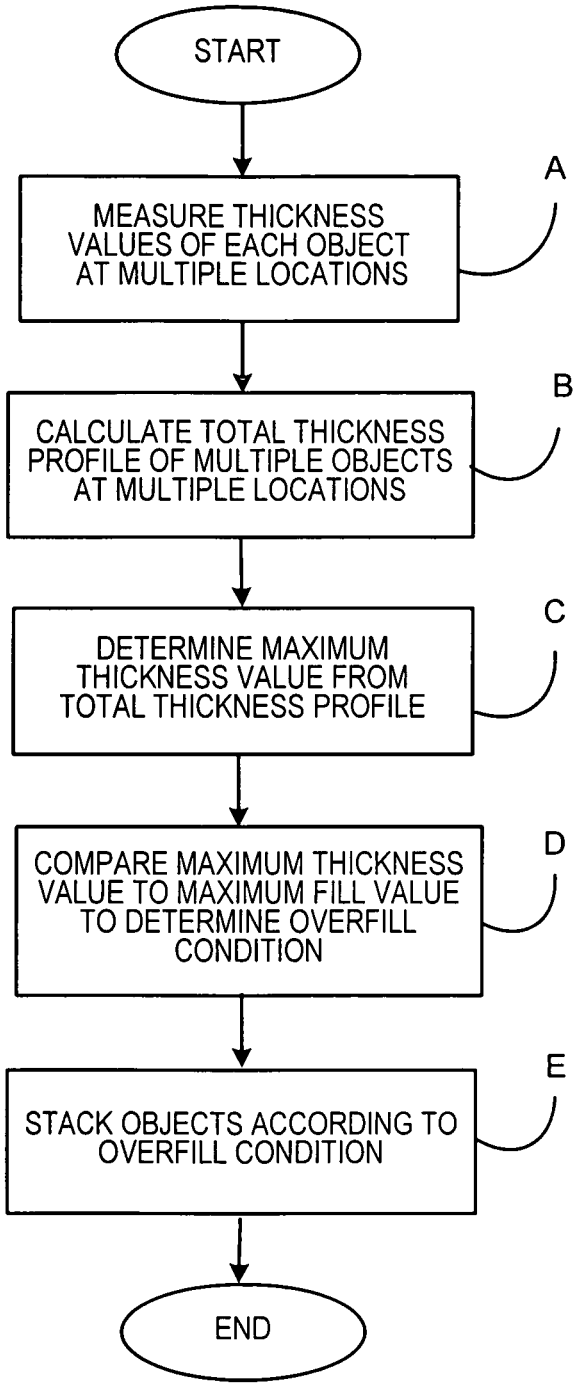
FIG. 1 is a flow diagram of a method for developing a thickness profile for use when stacking objects of irregular thickness/shape.

The invention will be fully understood when reference is made to the following detailed description taken in conjunction with the accompanying drawings.

SUMMARY OF THE INVENTION

A method is provided for stacking objects in a container including the step of measuring a thickness dimension of each object at a plurality of predetermined locations along a face surface of the object. A thickness profile is developed for a plurality of stacked objects, i.e., juxtaposed along each face surface, by summing each of the measured thickness dimensions at each of the predetermined locations. Next, a maximum thickness value for the stack is determined by comparing the summed cumulative thicknesses at each of the predetermined locations. Each of these cumulative thicknesses is then compared to a maximum fill value for each container to determine an overfill condition/number. The overfill condition corresponds to the number of objects which additively cause the maximum thickness value to exceed the maximum fill value. The objects may then be stacked based upon the overfill condition such that the total number of objects is less than the number corresponding to the overfill condition. The method facilitates optimum stacking of objects wherein at least one object has an irregular shape or non-uniform thickness profile.

The system may be configured to measure/monitor the surface profile or thickness using a plurality, e.g., two (2) or more, of spaced-apart sensors for taking measurements at a plurality, e.g., two (2) or more, lengthwise locations. In the context of mailstream sorting system, a map of thickness at various locations may be used for mixed-mail content including flats, letter and/or postcard size mailpieces. By arranging the sensors along the width and recording thickness readings at predetermined time intervals, a two-dimensional thickness profile is developed for each item.

This information may be stored in a computer database and used by the automated processing equipment, e.g., the controller of a mailpiece sorter, to calculate the optimum number of objects to be stacked into each container. Further, the objects or mailpieces may be assigned a unique identifier and thickness data may be associated with the identifiers maintained in the database. In a sorting application, the order of the objects to be stacked will normally be different than their order when the thickness was measured prior to sorting. When it is determined that a particular group of objects/mailpieces are to be co-located in a container for shipment/transport, the processor/controller may calculate the number of objects/mailpieces for each container based upon predetermined overfill conditions.

DETAILED DESCRIPTION

The present invention is described in the context of a mailpiece sorter having a device for measuring the thickness profile of each mailpiece being conveyed along and handled by the mailpiece sorter. It should be appreciated, however, that the invention is applicable to any apparatus for packing and transporting objects having an irregular or non-uniform thickness profile. Consequently, the system may be applicable to any transport or merchandise fulfillment system and the objects may be any of a variety of items conventionally shipped in commerce. Further, the thickness measurement device may be any of a variety of known methods or systems for contacting and characterizing the surface profile of an object in electronic, analog or digital form. For example, one or more Linear Variable Displacement Transducer (LVDT) or probe may be used to characterize the surface profile of the mailpiece/commercial item.

In FIG. 1, the method for optimally stacking objects in a container is outlined in steps A through E. In the broadest sense, the method steps include: (i) measuring a thickness value of each object at a plurality of predetermined locations in step A, (ii) calculating a cumulative thickness profile from a plurality of objects to be stacked, in step B, the cumulative thickness profile being developed by summing the thickness dimensions of multiple objects at each of the predetermined locations, (iii) determining a maximum thickness value from one or more of the summed thickness dimensions at the predetermined locations in step C, (iv) comparing the maximum thickness value to a maximum fill value for each container to determine an overfill condition (i.e., when the maximum thickness value exceeds the maximum fill value), in step D; and, (v) in step E, stacking objects in the container based upon the overfill condition (i.e., stacking a number of objects in the container that satisfy the overfill condition). Each of the method steps and apparatus employed to perform the various steps will be described in greater detail below.

Figure 2A:
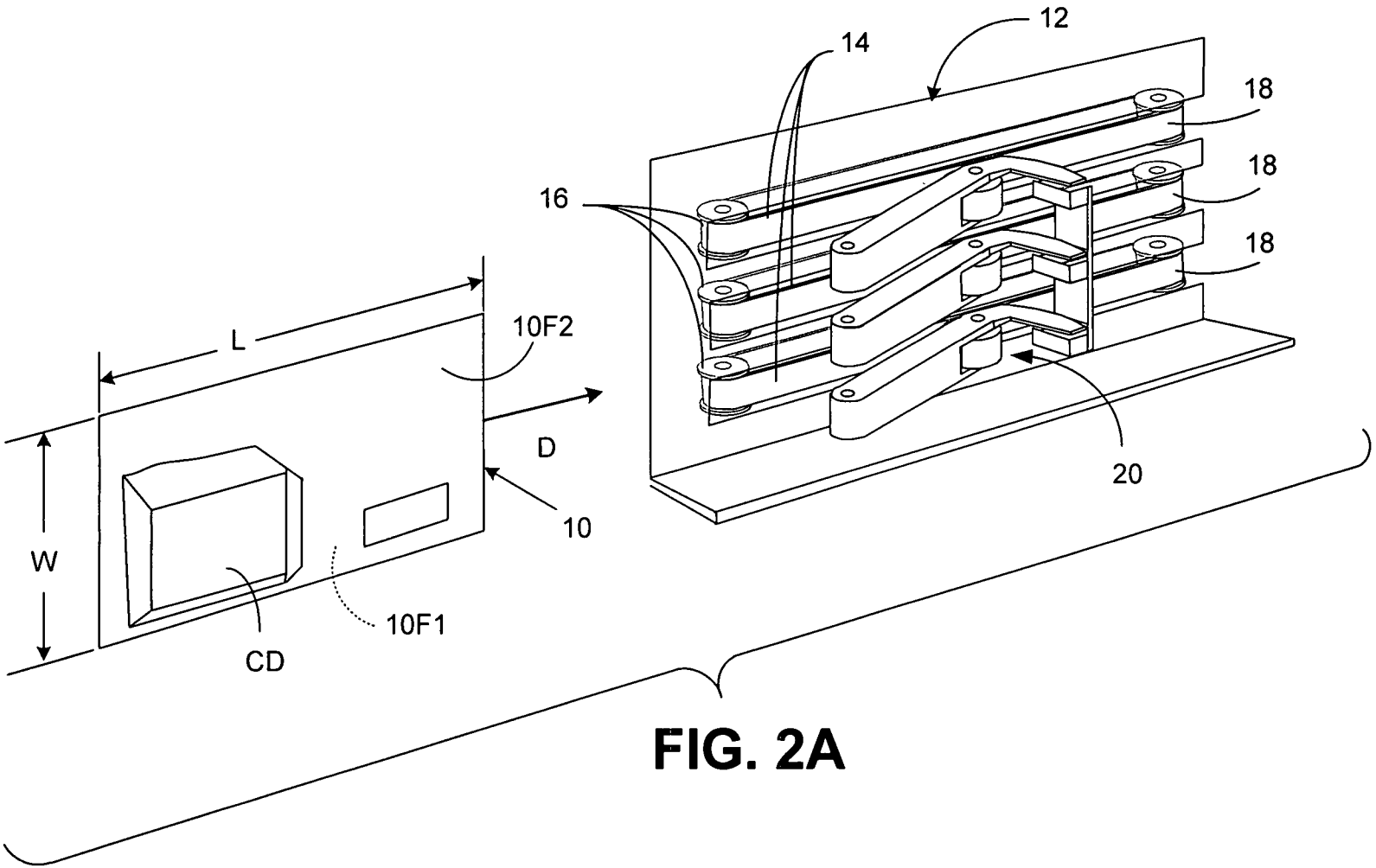
FIGS. 2*a* and 2*b* depict an embodiment of the present method wherein a mailpiece is shown advancing toward (in FIG. 2*a*) and in combination with (in FIG. 2*b*) a transport module of a mailpiece sorter and a device for developing a thickness profile of the mailpiece.
Figure 2B:
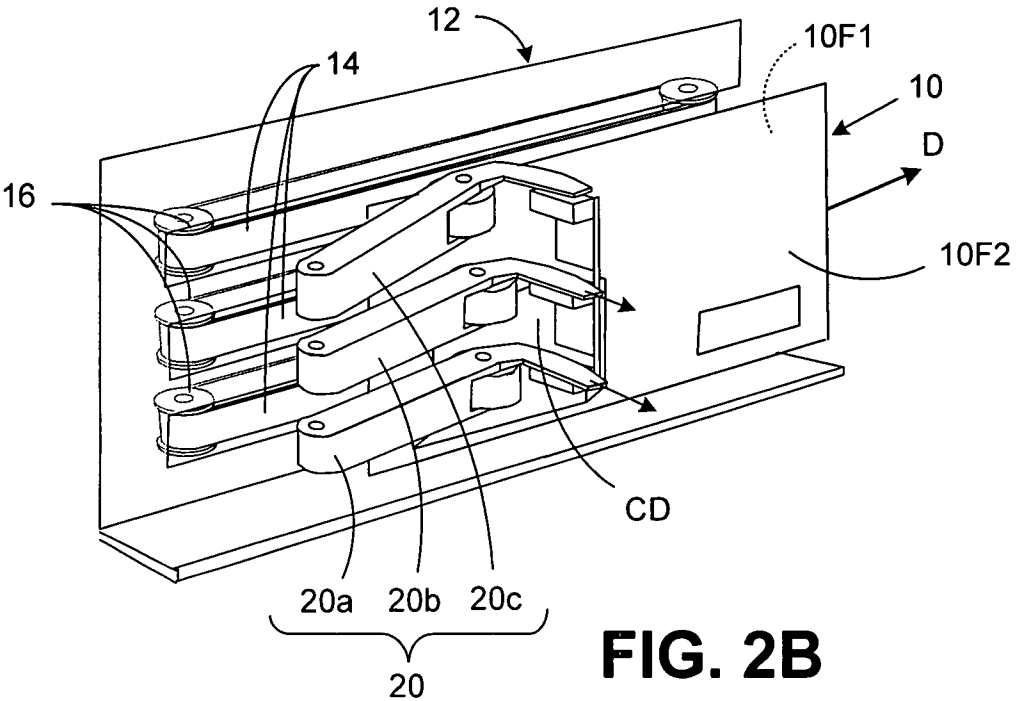

In FIGS. 2*a* and 2*b*, a mailpiece 10 is conveyed along a transport module 12 of a mailpiece sorter. For the purposes of illustration, the mailpiece 10 is shown having a rectangular shaped internal object CD which effects a change in thickness along its length L and width W. The transport module 12 may include a plurality of belts 14 each being driven about a pair of pulleys 16 which are aligned so as to define a common reference surface or deck 18. Furthermore, the outer surface of the belts 14 support and engage one of the face surfaces 10F1 of the mailpiece 10 for driving the mailpiece 10 in the direction of arrow D.

Figure 3:
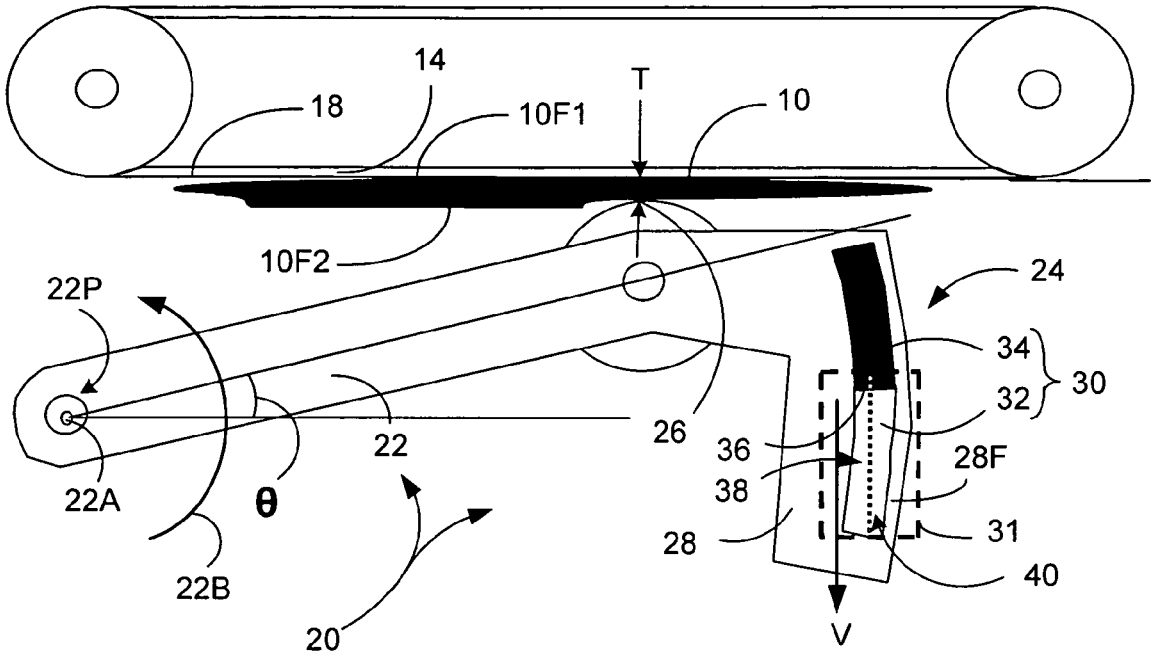
FIG. 3 is a top view of the thickness measurement device illustrating a pivotable arm operative to engage a face surface of the mailpiece and to measure thickness variations thereof as the mailpiece is conveyed by the transport module.

In FIGS. 2*a*, 2*b* and 3, a thickness measurement device 20 is disposed adjacent the reference surface or deck 18 of the transport module 12. More specifically, the thickness measurement device 20 includes a plurality of displacement arms 22 disposed in combination with an optical sensing device 24. Each displacement arm 22 pivotally mounts to a supporting structure (not shown) proximal to the face surface 10F2 of the mailpiece 10 and is rotationally biased toward the reference surface 18. Each arm 22, furthermore, defines an engagement surface 26 and a forward end portion 28 disposed outboard of the engagement surface 26 relative to the pivot mount 22P.

In the described embodiment the engagement surface 26 is an idler roller rotatably mounted to a mid-portion of the arm 22, however, the surface 26 may be any structure which permits low friction contact of the displacement arm 22 relative to the face surface 10F2 of the mailpiece 10. Furthermore, the engagement surface 26 contacts the face surface 10F2 such that the thickness dimension T of the mailpiece 10 is defined by the gap between the reference and engagement surfaces 18, 26. The forward end portion 28 of each displacement arm extends away from the mailpiece 10 and is oriented substantially normal to the face surface 10F2.

Figure 4:
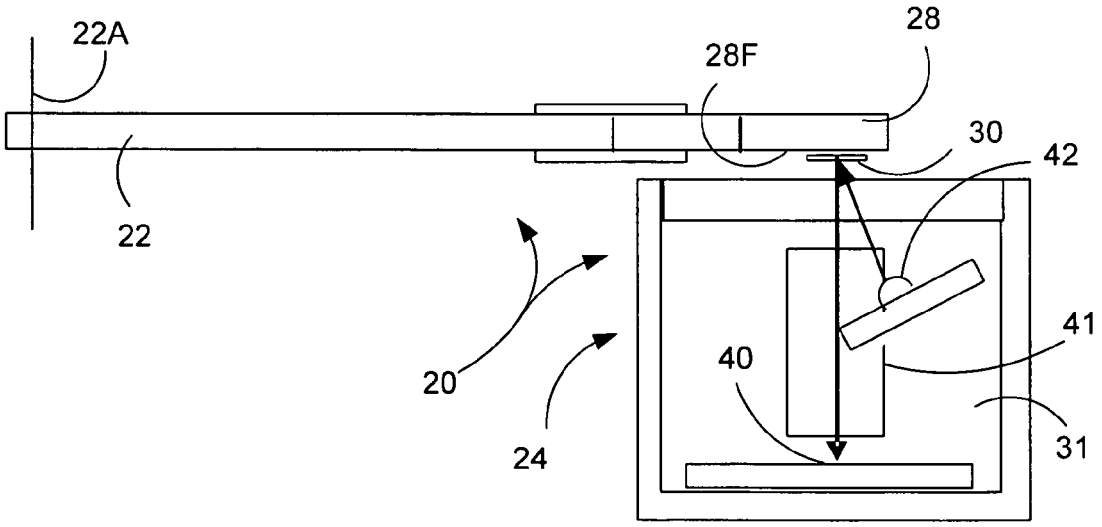
FIG. 4 depicts a schematic cross-sectional view of an image senor for viewing an image strip disposed in combination with the pivotable arm of the thickness measurement device.

In FIGS. 3 and 4, the displacement arms 22 define an acute angle θ relative to the reference line 26 (which is parallel to engagement surface 18) and are spring biased about the pivot axis 22A in a counterclockwise direction toward the mailpiece 10. As such, the engagement surface/idler rollers 26 are urged against and compress the mailpiece 10 such that a true or more accurate thickness dimension T is obtained. It will be appreciated that measurement devices which only define the spatial coordinates of a surface will not record the actual coordinates under normal loading conditions. Moreover, the displacement arms 22 are free to move in a direction substantially normal to the plane of the mailpiece 10 as the mailpiece thickness T varies. That is, the arms 22 are free to rotate about the pivot axis 22A to produce a component vector V orthogonal to the feed path D of the mailpiece 10.

The optical sensing device 24 includes an image strip 30 and image sensor 31. More specifically, the image strip 30 attaches to a face surface 28F of the forward end portion 28 of each displacement arm 22 and includes segments which are both reflective and absorptive. More specifically, the image strip 30 comprises a reflective segment 32 along a first half of the strip 30 and an absorptive segment 34 disposed along a second half of the strip 30. In the described embodiment, the reflective segment 32 has a reflective white surface and the absorptive segment 34 has an absorptive black surface. Furthermore, the image strip 30 includes a change in the light/reflection properties by defining an abrupt optical transition line 36 (see FIG. 3) or interface between the reflective and absorptive segments 32, 34.

The image sensor 31 (shown in dashed lines in FIG. 3) operates in conjunction with the image strip 30 to detect the orthogonal movement of the arm 22 and, consequently, the thickness profile of the mailpiece. More specifically, the image sensor 31 includes a linear array of optical sensors or photosensitive cells 40 which are light sensitive, i.e., a rod lens 41, and an LED illumination strip 42 which shines light onto the image strip 30 such that light energy is either absorbed or reflected back to the optical sensor array 40 through the rod lens 41.

Figure 5:
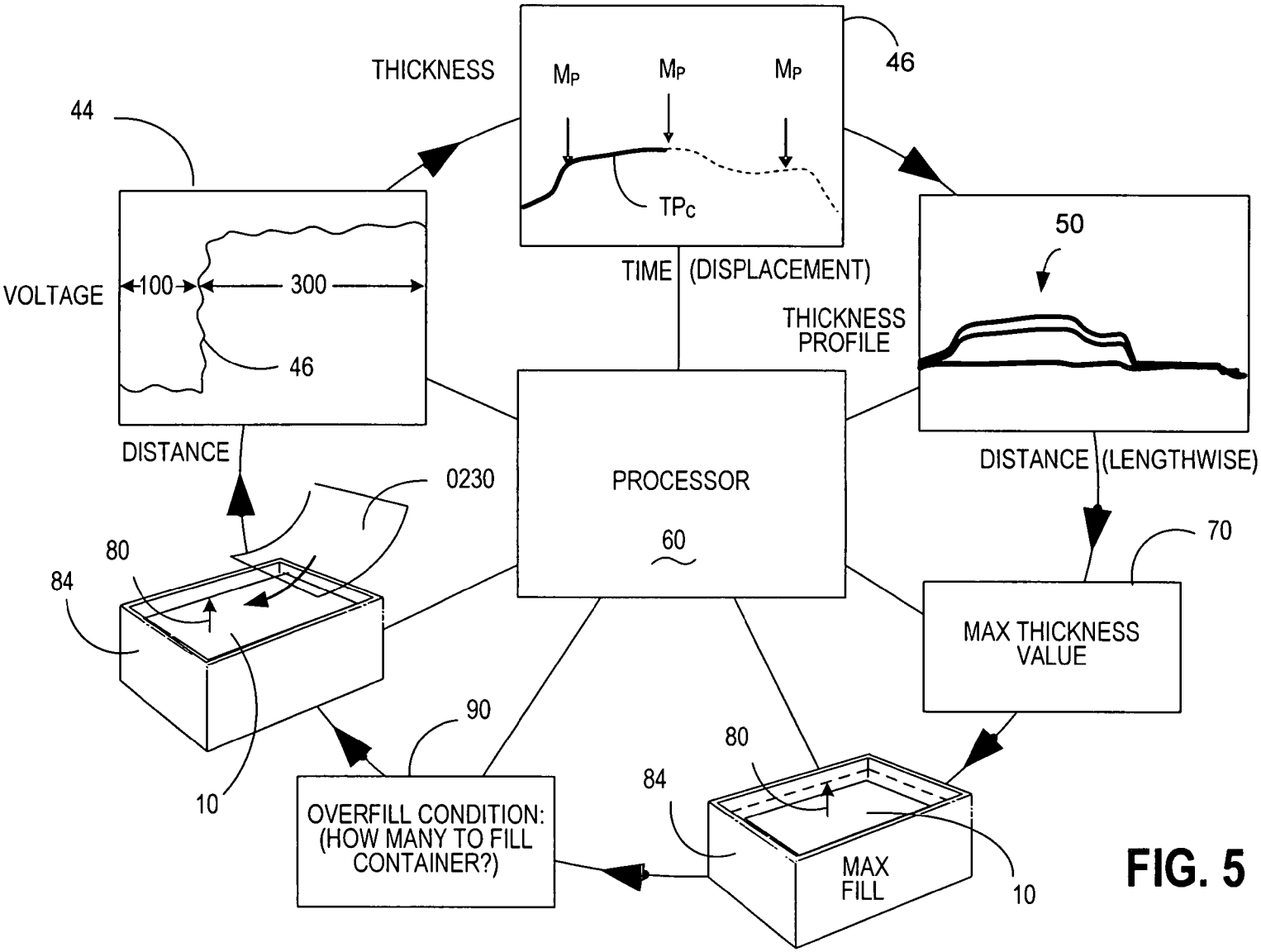
FIG. 5 pictorially depicts the electronic output of the thickness measurement device together with the steps performed by a processor to store, generate and/or combine measured thickness data to produce an overfill condition, i.e., the number of mailpieces which may be stacked in a particular mailpiece container/tray.

In FIGS. 3, 4 and 5, depending upon the profile reflected or absorbed by the image strip 30, the image sensor 31 is operative to develop a voltage response curve 44 (see FIG. 5) indicative of position of the optical transition line 36 (FIG. 3). More specifically, at any location along the length L of the mailpiece 10, the voltage response curve 44 of the image sensor 31 determines (i) the location of the transition line 36, (ii) the orthogonal displacement of the displacement arm 22 and, consequently, (iii) the thickness T of the mailpiece 10. For example, an image sensor 31 having a resolution of four-hundred dots per inch (400 dpi) has a linear array 38 and 40 comprising four hundred closely-spaced photocells (depicted as aligned dots in FIG. 3) spanning one inch in length. If the optical transition line 36 is positioned at the twenty-fifth percentile (25%) mark of the linear array 38, then one-hundred (100) of the photocells would transmit a low voltage while the remaining three-hundred would transmit a substantially higher voltage. The transition point 46 (see FIG. 5) from the low to high voltage corresponds to the location of the optical transition line 36 on the image strip 30 and, consequently, the thickness T of the mailpiece 10.

As the mailpiece is transported in direction D (see FIG. 2*b*) multiple thickness measurements may be taken/recorded across a plurality of points or locations, i.e., at small time increments or intervals. In this way, the optical sensing device 20 produces dimensions/values of mailpiece thickness along the entire length of the mailpiece 10. While the thickness dimensions may be measured along the entire length of the mailpiece 10 to produce a continuous thickness profile $TP_C$, thickness information may be stored at several select locations. For example, the thickness dimensions may be stored at three (3) locations along the length (each recorded measurement location being indicated by an arrow $M_P$ projecting vertically downward), to minimize the data storage and processing requirements. The thickness profile shown in the graphical illustration 46 of FIG. 5 is plotted against time or displacement as the mailpiece passes beneath the thickness measurement device 20.

Furthermore, it will be appreciated that the thickness measurement device 20 comprises a plurality of displacement arms 22 equally spaced vertically along the width W of the mailpiece 10 (as shown in FIGS. 2*a* and 2*b*). In the described embodiment and referring to FIGS. 2*a*, 5 and 6, the thickness measurement device 20 includes three (3) pairs of displacement arms 22 and image sensors 24, each pair corresponding to one of the linear belts 14 of the transport module 12. Consequently, if the three (3) pairs of measurement devices 22, 24 are disposed at three equally spaced locations W1, W2 and W3, and these record measurements at, for example, three (3) lengthwise locations, L1, L2 and L3, then a three by three (3×3) array or matrix of thickness dimensions can be recorded for each mailpiece 10.

Upon recording and storing an array of thickness dimensions in step A of the method for each mailpiece 10, the data may be stored and manipulated to determine the number of mailpieces 10 which may be laid to fill a mailpiece container. More specifically and referring to FIG. 5, the voltage response curve data 44 for each sensor is converted to thickness profile data 45 by a processor 60. The multiple thickness dimensions 50 of each mailpiece 10 may be stored in the memory of a processor 60 and, in step B, combined or summed in the order in which the mailpieces are to be stacked to determine a cumulative thickness profile 70 of a plurality of stacked mailpieces 10. The order of mailpieces may be different for measuring steps than for the steps of determining accumulation thickness. For example, in a mail sorting application, the order of pieces will be substantially changed.

Figure 6:
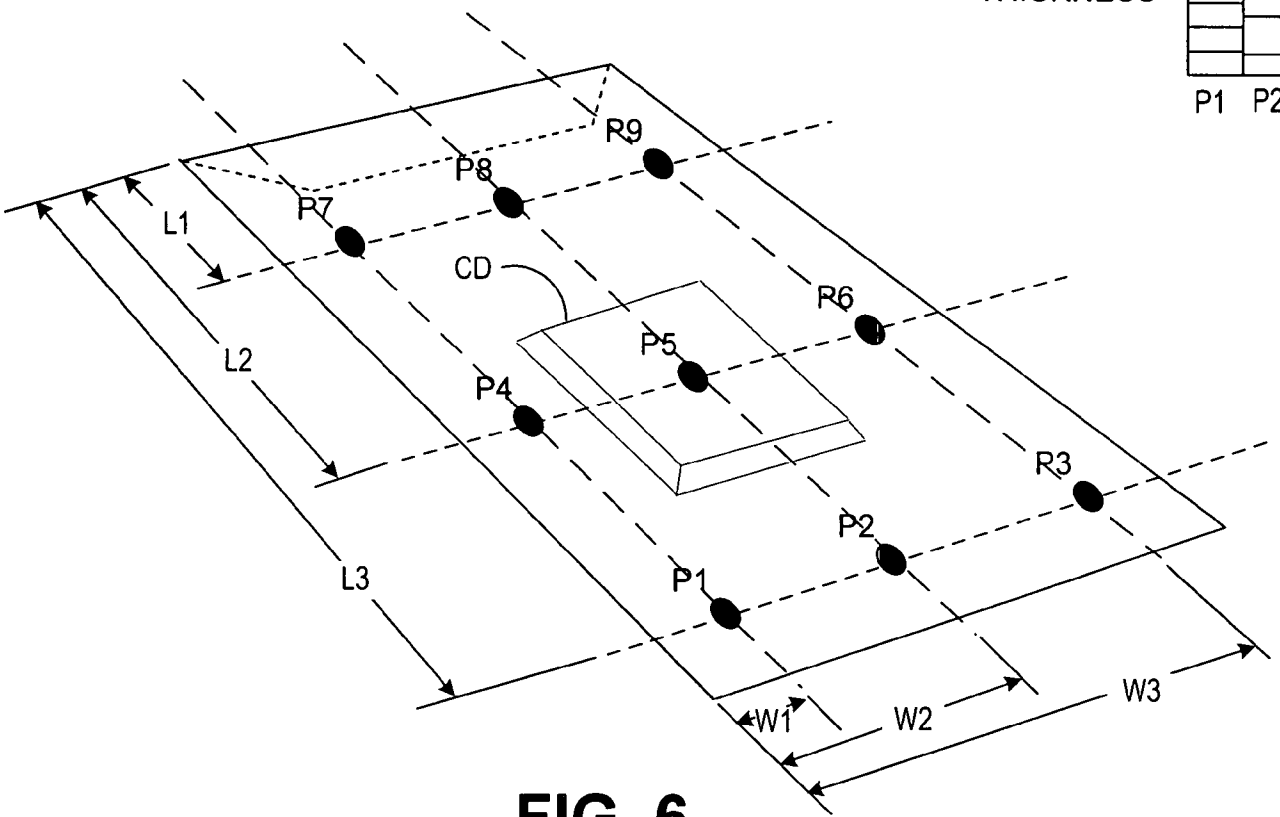
FIG. 6 is a perspective schematic view of a flats type mailpiece illustrating various locations which may be designated for measuring mailpiece thickness.

FIG. 6 shows by example, nine (9) measurement locations P1 through P9 taken along the length and width of a mailpiece 10, each point having a measured and recorded mailpiece thickness. Measurement at these same locations P1 through P9 are taken for each mailpiece 10. Whether the mailpieces are to be stacked in the original order or re-ordered (as in a sorting application), the processor 60 begins to sum the cumulative thicknesses of multiple mailpieces in the order in which they will be stacked at each of the points P1 through P9.

To achieve the desired accuracy, it will be necessary to coordinate the spatial relationship and movement of the mailpiece with the thickness measurement device. That is, the location and rate of displacement must be known for the thickness measurement device to accurately record measurements at the predetermined locations. Assuming a constant velocity of the transport module 12, the thickness measurement can be recorded at three time intervals from the time the leading edge of a mailpiece 10 passes a known point on the transport. These consistent time intervals will translate into consistent locations on the surface of each mailpiece where the thickness dimensions are recorded in memory. Those skilled in the art of document/material handling are well versed in the machine synchronization required to perform the requisite thickness measurements. It will be noted that for mailpieces having smaller dimensions (e.g., a letter size mailpiece) one or more of the arms 22 may not displace or pivot as the mailpiece passes particular points e.g., points P7, P8 and P9 (of FIG. 6) inasmuch as the engagement surface does not contact the mailpiece 10. In these instances, the thickness dimension will be recorded as a null or zero (0) value and summed with the thickness dimensions of other mailpieces, e.g. those which are larger and have a positive thickness value at the corresponding points. Accordingly, a detailed discussion of the implementing control system logic/algorithms is not provided nor is such description necessary for teaching the invention.

It will also be appreciated that a far greater number of measurements may be taken/recorded in the lengthwise direction, i.e., in contrast to the widthwise direction, inasmuch as the arms 22 contact all points along the mailpiece length L. The number of measurements in the widthwise direction, however, is limited to the number arms 22 and image sensors 24 which may be practically introduced within the bounds defined by the mailpiece width W.

Continuing with our example wherein thickness dimensions are measured and recorded at nine data points P1-P9 for each mailpiece, the processor or controller 60 determines how many mailpieces 10 are to be placed in each container. The mailpieces 10 may be stacked in the same order as they were measured, or they may be re-ordered. For example, all mailpieces 10 going to a particular postal code may be sorted/grouped before the processor 60 starts to sum the thickness dimensions of these mailpieces 10.

Figure 7:
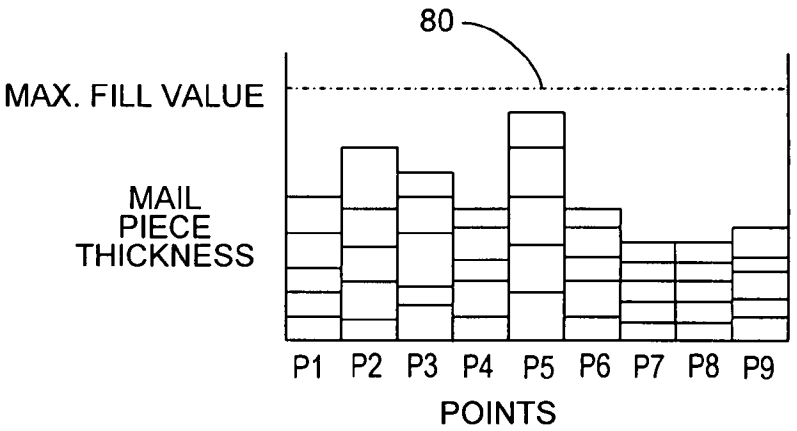
FIG. 7 is a stacked bar chart illustrating the summation of mailpiece thickness dimensions for a plurality of mailpieces.

In FIG. 7, when the correct order for stacking is known, the cumulative dimensions are summed at each of the nine points P1 through P9. As the thickness values for each mailpiece are summed, the cumulative thickness value at each of the nine points P1 through P9 is compared with the maximum fill value (shown as a horizontal line 80) of the container 84 in Step D. Generally, the maximum fill value 80 will be a value stored in processor memory, however, other methods or sensors may be employed to determine or develop the container fill value 80 for comparison purposes. Further, as the maximum thickness value 70 approaches or exceeds the maximum fill value 80, the processor 60 determines an overfill condition 90. For example the overfill condition 90 may indicate that stacking of mailpiece numbers 0001 through 0231 results in a maximum thickness value 70 which exceeds the maximum fill value 80, hence, the previous mailpiece in the sequence i.e., number 00230, should be the last mailpiece 10 to be stacked in the container 84. Finally, in step E, the mailpieces 10 are stacked in accordance with the overfill condition 90. That is, the processor may determine the maximum number of mailpieces 10 to be stacked in container 84 while the stacking operation is in process or, alternatively, before the stacking process begins. In either case, the processor determines the exact pieces required in the appropriate order to fill a container.

In summary, thickness information for each mailpiece 10 is measured and recorded at the same nine points P1-P9 on the surface 10F2 of each mailpiece 10. In one embodiment of this invention, the mailpieces 10 are moved through a sorting operation and their order is substantially modified from the original order in which the thickness profile of each piece is measured and recorded.

In yet other embodiments, the mailpieces 10 will be stacked one at a time into containers positioned at each sorting location within the sorter. In other applications, the sorted mailpieces will be collected at the sorted locations within the sorter, and then moved to a stacking location for stacking into containers in a separate step. In either embodiment, the sorted order of the mailpieces will be known by the sorter controller.

In Step C, the processor 60 calculates the cumulative thickness of the mailpieces 10 before they are stacked, at each of the nine (9) locations P1-P9 of the three by three (3×3) matrix where the thickness dimensions were recorded. For each next mailpiece to be stacked, the processor 60 adds the thickness dimensions at each of the nine locations P1-P9 to the sum of the nine points on the other mailpieces previously summed and compares the calculated cumulative thickness dimensions at each of the nine points to determine when the cumulative thickness dimension of any one of the nine thickness dimensions exceeds the maximum fill value 80 for the container 84.

If the cumulative thickness dimensions for each nine points P1-P9 in the matrix remains below the maximum fill value 80, the mailpiece 10 to be stacked is stacked in the container 84, and the next sorted mailpiece 10 is considered. When any of the cumulative thickness dimensions at the nine points exceeds the maximum fill value (step D of FIG. 1), the number of mail pieces required to fill container 84 without overfilling is known. Stated in slightly different terms, the mailpiece 10 that causes at least one of the cumulative thickness dimensions at one of the nine thickness dimension locations P1-P9 to exceed the maximum fill value 80 becomes the first mailpiece 10 to be stacked in a subsequent empty container. The processor 60 then resets the cumulative thickness calculations to include only the nine thickness dimensions on the subject mailpiece 10 stacked in the new container, and continues to calculate cumulative thickness dimensions by adding the thickness dimensions for the subsequent mailpieces.

It will be appreciated that in some sorter applications, this process may be accomplished before the actual stacking in the container 84 occurs. Once the sorted order of the mailpieces 10 is known, the correct number of sorted mailpieces required to fill each container 84 can be grouped to determine the number of mailpieces 10 which optimally fill each container 84. This can, of course, occur while the mailpieces are in transit, i.e., being transported toward an automated stacking station.

Although the invention has been described with respect to a preferred embodiment thereof, it will be understood by those skilled in the art that the foregoing and various other changes, omissions and deviations in the form and detail thereof may be made without departing from the scope of this invention. For example, while the thickness measurement device includes an optical sensing device 24, i.e., image sensor 31 and image strip 30, to produce the thickness dimensions of each mailpiece, it will be appreciated that other sensing devices can be employed. A simple linear probe such as a linear variable displacement transducer (LVDT) may be employed to measure mailpiece thickness. Furthermore, a rotary encoder or rheostat mounted about the pivot axis of the rotating arm 22 may be employed to measure its angular displacement as the idler roller is displaced by thickness variations. The angular displacement can then be used to calculate the linear displacement and, consequently, thickness dimensions of the mailpiece.

What is claimed is:

1. A method for stacking objects in a container, comprising the steps of:

measuring thickness dimensions of each object at a plurality of predetermined locations;

calculating a cumulative thickness profile of a plurality of stacked objects, the cumulative thickness profile being developed by summing the respective thickness dimensions of each object at each of the predetermined locations;

determining a maximum thickness value from the cumulative thickness profile in connection with the thickness dimensions at each of the plurality of predetermined locations;

comparing the maximum thickness value to a maximum fill value for each container to determine an overfill condition;

stacking objects in the container based on the overfill condition, wherein the step of measuring the thickness dimensions is performed by measuring the displacement of an arm engaging the face surface of the object, wherein the step of measuring the thickness dimensions is performed by an image sensor for optically viewing an image strip disposed in combination with the displacement arm, and wherein the image sensor includes a linear array of photosensitive sensors and an illumination device, wherein the image strip includes regions which absorb and reflect light energy, the regions forming an abrupt transition line which is displaced by movement of the pivot arm, and wherein the photosensitive sensors detect the movement of transition line when illuminated by the illumination device to measure the thickness of the object.

2. The method according to claim 1 wherein displacement of the arm is measured by an optical sensing device.

3. The method according to claim 1 wherein displacement of the arm is measured by a rotary transducer.

4. A method for stacking mailpieces having variable thickness characteristics in a mailpiece container/tray, comprising the steps of:

conveying mailpieces along a transport;

coordinating the spatial relationship and movement of the mailpieces on the transport with a thickness measurement device;

measuring thickness dimensions of each mailpiece at predetermined locations as the mailpiece passes the thickness measurement device;

calculating a cumulative thickness profile of a plurality of mailpieces, the cumulative thickness profile being developed by summing the respective thickness dimensions of each mailpiece at the predetermined locations;

determining a maximum thickness value from the cumulative thickness profile in connection with the thickness dimensions at each of the plurality of predetermined locations;

comparing the maximum thickness value to a maximum fill value for each mailpiece container to determine an overfill condition; and stacking mailpieces in the mailpiece container based on the overfill condition, wherein the step of measuring the thickness dimensions is performed by measuring the displacement of an arm engaging the face surface of the mailpiece, wherein the step of measuring the thickness dimensions is performed by an image sensor for optically viewing an image strip disposed in combination with the displacement arm, and wherein the image sensor includes a linear array of photosensitive sensors and an illumination device, wherein the image strip includes regions which absorb and reflect light energy, the regions forming an abrupt transition line which is displaced by movement of the pivot arm, and wherein the photosensitive sensors detect the movement of transition line when illuminated by the illumination device to measure the thickness of the mailpiece.

5. The method according to claim 4 wherein displacement of the arm is measured by an optical sensing device.

6. The method according to claim 4 wherein displacement of the arm is measured by a rotary transducer.

7. The method according to claim 4 further comprising the step of assigning a unique identifier in connection with each mailpiece.

8. A method for stacking objects in a container, comprising the steps of:

measuring thickness dimensions of each object at a plurality of predetermined locations, wherein the measuring the thickness dimensions includes measuring multiple thickness measurements across a plurality of same points along an entire length for the each object to produce an array of thickness dimensions for the each object at the same points;

calculating a cumulative thickness profile of a plurality of stacked objects, the cumulative thickness profile being developed by summing the respective thickness dimensions of each object at each of the predetermined locations;

determining a maximum thickness value from the cumulative thickness profile in connection with the thickness dimensions at each of the plurality of predetermined locations;

comparing the maximum thickness value to a maximum fill value for each container to determine an overfill condition;

stacking objects in the container based on the overfill condition; and storing the array of thickness dimensions for the each of the plurality of objects as measured at the plurality of same points for the each object.

9. The method according to claim 8 wherein the summing the respective thickness dimensions comprises summing each of the thickness dimensions as measured at each same point for the each of the plurality of objects.

10. The method according to claim 9 further comprising the steps of coordinating the spatial relationship and movement of the objects with a thickness measurement device to ensure that the thickness dimensions are measured at the plurality of same points along an entire length for the each object.

11. The method according to claim 9 wherein the comparing the maximum thickness value to a maximum fill value for each container to determine an overfill condition comprising comparing each of the summed dimensions as measured at each same point for the each of the plurality of objects to the maximum fill value for each container.

* * * * *